US007664417B2

(12) United States Patent
Hori et al.

(10) Patent No.: US 7,664,417 B2
(45) Date of Patent: Feb. 16, 2010

(54) FIXING APPARATUS AND IMAGE FORMING APPARATUS INCLUDING THE SAME

(75) Inventors: Hiroaki Hori, Kyoto (JP); Yoshinobu Tateishi, Nara (JP); Kohji Aoki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 147 days.

(21) Appl. No.: 11/688,895

(22) Filed: Mar. 21, 2007

(65) Prior Publication Data

US 2007/0230982 A1 Oct. 4, 2007

(30) Foreign Application Priority Data

Mar. 28, 2006 (JP) ..... 2006-089405

(51) Int. Cl.
*G03G 15/20* (2006.01)

(52) U.S. Cl. ..... 399/69; 399/70

(58) Field of Classification Search ..... 399/69, 399/70, 67

See application file for complete search history.

(56) References Cited

U.S. PATENT DOCUMENTS 5,708,920 A * 1/1998 Ohnishi et al. ..... 399/69
6,411,785 B1 * 6/2002 Ogawahara et al. ..... 399/69
2005/0074252 A1 * 4/2005 Hirst et al. ..... 399/69
2007/0212093 A1 * 9/2007 Maeda et al. ..... 399/69

FOREIGN PATENT DOCUMENTS

JP 08-190294 7/1996
JP 2002-043026 2/2002
JP 2002-43026 * 2/2002

* cited by examiner

*Primary Examiner*—David M Gray
*Assistant Examiner*—Billy J Lactaoen
(74) *Attorney, Agent, or Firm*—Renner, Otto, Boisselle & Sklar LLP

(57) ABSTRACT

A fixing apparatus and an image forming apparatus of the present invention are arranged so that a fixing control section causes a fixing roller to additionally rotate so that the additional rotation corresponds to a driving delay time also after turning OFF an external heating roller heater when shifting from a temperature raising step in which surface temperature of the fixing roller is raised so as to be equal to a preset fixing temperature to a standby mode and when turning OFF the external heating roller heater and stopping the fixing roller. As a result, it is possible to provide a fixing apparatus and an image forming apparatus in which a surface of a fixing roller is free from deterioration or breakage caused by local heating carried out by an external heating roller.

7 Claims, 11 Drawing Sheets

FIXING APPARATUS AND IMAGE FORMING APPARATUS INCLUDING THE SAME

This Nonprovisional application claims priority under 35 U.S.C. § 119(a) on Patent Application No. 089405/2006 filed in Japan on Mar. 28, 2006, the entire contents of which are hereby incorporated by reference.

FIELD OF THE INVENTION

The present invention relates to (i) a fixing apparatus incorporated into an image forming apparatus using an electrophotographic process, for example, a copying machine, a facsimile, a printer, and a multifunction machine, and (ii) an image forming apparatus using the same.

BACKGROUND OF THE INVENTION

Conventionally, a heat roller fixing method has been generally used in a fixing apparatus incorporated into an image forming apparatus using an electrophotographic process. A copying machine and a printer are examples of such image forming apparatus. In the heat roller fixing method, a heated fixing roller and a pressure roller are press-contacted to each other. A paper sheet (recording material) holding an unfixed toner image thereon passes between the fixing roller and the pressure roller so that the toner image is fused and fixed on the paper sheet.

Recently, the image forming apparatus has been desired to carry out processes at higher speed. Accordingly, the number of sheets processed per unit of time increases and speed at which the sheets are transported becomes higher. For example, an apparatus which processed 60 sheets per minute (horizontal transportation of A4 sheets) was regarded as a high speed apparatus conventionally, but an apparatus which processes 80 or more sheets per minute is regarded as a high speed apparatus recently. Nowadays, an apparatus which can process 100 or more sheets per minute has been developed.

A fixing apparatus incorporated into such a high speed apparatus adopts a mode (external heat fixing mode) in which external heating means is provided on an external periphery of the fixing roller and the fixing roller is heated from the outside (from the surface side) in order to quickly heat the surface of the fixing roller and reduce total power consumption of the whole apparatus.

As the external heating means, there are proposed (i) a belt type in which an endless belt is suspended between a plurality of heating rollers each of which has a heat source therein so that the heated belt member is brought into contact with the fixing roller and (ii) a roller type in which a heating roller (hereinafter, referred to as "external heating roller") is brought into contact with a surface of the fixing roller.

Generally, the external heating roller is arranged so that a heater serving as a heat source is disposed in an extremely thin cylinder having an excellent heat conductivity and made of aluminum, iron material, or the like. The thinness of the external heating roller allows its surface to be quickly heated with a heat amount supplied from the heater, so that it is possible to quickly heat the surface of the fixing roller by bringing the external heating roller into contact with the fixing roller (quick heating property).

[PATENT DOCUMENT 1]

Japanese Unexamined Patent Publication No. 190294/1996 (Tokukaihei 8-190294)(Publication date: Jul. 23, 1996)

However, the conventional fixing apparatus having the external heating roller raises such a problem that: after finishing the step of heating the fixing roller, e.g., after finishing the fixing roller warm up step and the fixing step, the fixing roller is locally heated in a portion which is in contact with the external heating roller, so that the surface of the fixing roller is deteriorated or broken.

A temperature of the fixing roller is controlled by electrifying and stopping electrifying the heaters of the fixing roller and the external heating roller, e.g., by electrifying the heaters until a surface temperature of the fixing roller rises so as to be equal to a preset fixing temperature and by stopping electrifying the heaters when the surface temperature rises so as to be equal to the preset fixing temperature.

While, the fixing roller is driven in the following manner. In the temperature raising step of heating the fixing roller, e.g., in the warm up step, the fixing roller is rotated until the surface temperature of the fixing roller becomes equal to the preset fixing temperature, and the rotation of the fixing roller is stopped when the surface temperature becomes equal to the preset fixing temperature. Further, in the step of keeping the temperature, e.g., in the standby step which is carried out after the warm up step and before receiving an instruction to carry out the printing process, the fixing roller stops. The pressure roller and the external heating roller are arranged so as to be rotated by being brought into contact with the surface of the fixing roller, and rotations of the pressure roller and the external heating roller are stopped by stopping the rotation of the fixing roller.

FIG. 11 shows a conventional fixing apparatus and illustrates turning ON/OFF of each heater, ON/OFF of a driving source of a fixing roller, and variation of surface temperature of each roller, in shifting to a standby mode through a warm up step on start up.

The electrifications of the heaters of the fixing roller, the pressure roller, and the external heating roller are synchronously controlled during warm up, and the heaters are turned OFF when the surface temperature of the fixing roller becomes equal to the preset fixing temperature and the warm up is finished, and then they become in a standby mode. During the standby mode, the heater of the external heating roller is kept OFF, and only the heaters of the fixing roller and the pressure roller are turned ON when the surface temperature of the fixing roller is lower than the preset fixing temperature and are turned OFF when the surface temperature is higher than the preset fixing temperature. Note that, in FIG. 11, a surface temperature of each roller keeps on rising after turning each heater OFF because of time loss of heat conduction in the roller.

Meanwhile, the fixing roller is turned ON after beginning the warm up and when the surface temperature of the fixing roller exceeds a toner softening temperature. Thereafter, the fixing roller is turned OFF when the surface temperature of the fixing roller becomes equal to the preset fixing temperature and the warm up is finished, and the fixing roller is kept OFF in the standby mode.

As illustrated in FIG. 11, in driving the heater and the driving source in the conventional manner, overshoot which is sudden rise of the surface temperature of the external heating roller occurs right after finishing the warm up. That is, as described above, the external heating roller is so thin as to quickly heat the fixing roller, and a temperature gradient between the heat source of the external heating roller and the fixing roller is set so as to be great. Thus, although the heater of the external heating roller is turned OFF, heat conduction from the external heating roller to the fixing roller is instantly cut off when the rotation of the fixing roller is suddenly stopped. As a result, the surface temperature of the external heating roller suddenly rises. When the temperature exceeds an endurable temperature of a surface layer of the fixing roller, the fixing roller is locally heated in a portion which is in contact with the external heating roller, so that the fixing roller is deteriorated or broken.

SUMMARY OF THE INVENTION

The present invention was made in view of the foregoing problems, and an object of the present invention is to provide a fixing apparatus and an image forming apparatus in which the surface of the fixing roller is free from deterioration or breakage caused by local heating carried out by the external heating roller.

In order to solve the problems, a fixing apparatus of the present invention includes: a fixing member which is rotatable; a pressure member for pressing the fixing member; and an external heating member for coming into contact with a surface of the fixing member so as to heat the surface from outside, a recording material being allowed to pass through a space between the fixing member and the pressure member so as to fix a toner image formed on the recording material, said fixing apparatus comprising a control section for controlling a state in which the fixing member is driven and for controlling a state in which power is supplied to heat sources respectively provided in the fixing member and the external heating member, wherein the control section carries out a first fixing member maintenance process, in which the fixing member is kept rotating also after stopping supplying power to the heat source of the external heating member, when shifting from a temperature raising step for raising a surface temperature of the fixing member so that the surface temperature is equal to a preset fixing temperature to a standby mode so as to stop supplying power to the heat source of the external heating member.

Further, an image forming apparatus of the present invention includes the aforementioned fixing apparatus.

As described above, when the rotation of the fixing member is stopped at the same time as in stopping supplying power to the heat source of the external heating member, there occurs overshoot which is sudden rise of the surface temperature of the external heating member, so that the fixing member may be deteriorated or broken.

According to the foregoing arrangement, the first fixing member maintenance process is carried out, so that the fixing member keeps rotating for a predetermined period also after stopping supplying power to the heat source of the external heating member. Thus, no overshoot occurs, and the surface temperature of the external heating member does not exceed the durable temperature of the fixing member at the time when the fixing member stops rotating. As a result, it is possible to prevent deterioration or breakage of the fixing member.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 3(*b*) is a cross sectional view of an end portion of the fixing unit.

DESCRIPTION OF THE EMBODIMENTS

The following explains an image forming apparatus according to one embodiment of the present invention with reference to FIG. 1 to FIG. 10. Note that, the present invention is not limited to this.

Figure 2:
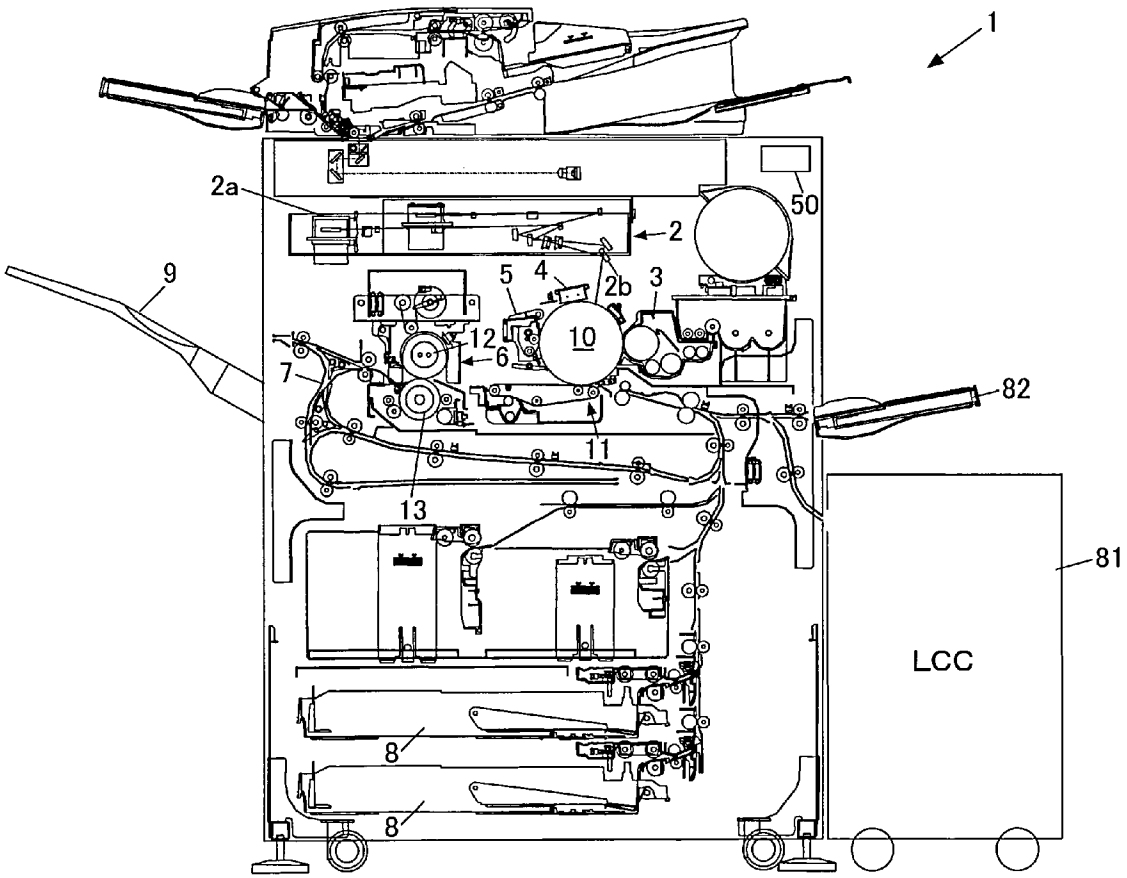
FIG. 2 shows an embodiment of the present invention and is a vertically cross sectional view illustrating an arrangement of an image forming apparatus including the fixing unit.

FIG. 2 is a cross sectional view schematically illustrating an image forming apparatus 1 according to the present embodiment. The image forming apparatus 1 according to the present embodiment forms a monochrome image on a predetermined sheet (recording sheet) in accordance with image data transmitted from the outside or image data scanned by the image forming apparatus 1 per se. As illustrated in FIG. 2, the image forming apparatus 1 includes an exposure unit 2, a developing device 3, a photoreceptor drum 10, a transfer unit 11, an electric charging unit 4, a cleaning unit 5, a fixing unit (fixing apparatus) 6, a sheet feed tray 8, a output paper tray 9, a control section 50, and the like.

The electric charging unit 4 serves as charging means for uniformly charging a surface of the photoreceptor drum 10 so as to have a predetermined potential. As the electric charging unit 4, a non-contact and discharging type electric charging unit illustrated in FIG. 2 may be used, or a roller or brush type contact electric charging unit may be used.

The exposure unit 2 exposes the photoreceptor drum 10 which has been uniformly charged by the electric charging unit 4 so as to form an electrostatic latent image corresponding to image data on a surface of the photoreceptor drum 10.

Figure 1:
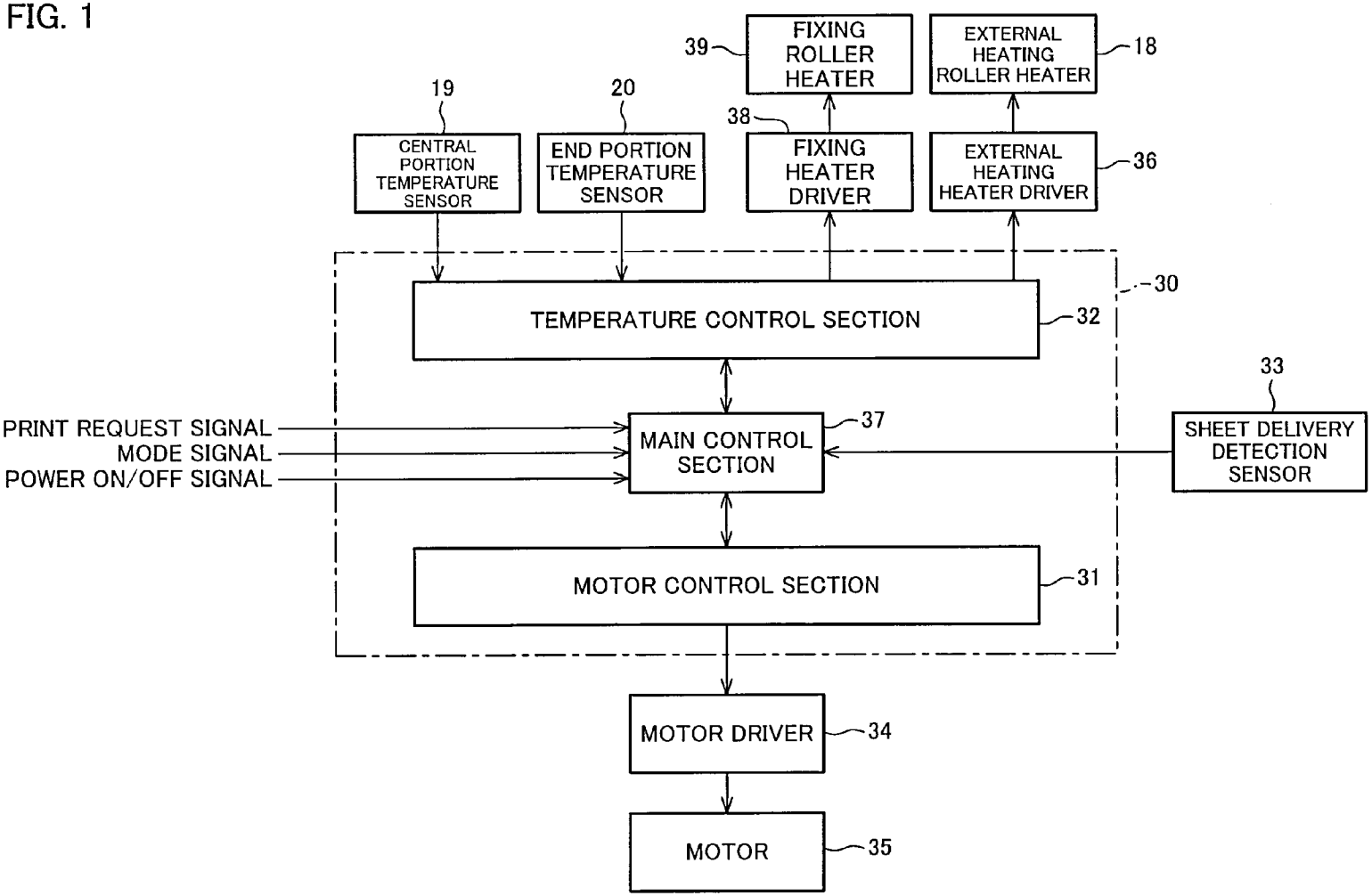
FIG. 1 shows an embodiment of the present invention and is a block diagram illustrating a structure of a control system of a fixing unit.

As the exposure unit 2, a laser scanning unit which includes a laser irradiation section 2*a* and a reflecting mirror 2*b* as illustrated in FIG. 1 may be used, or a writing head in which light emitting elements (EL or LED for example) are arranged in an array manner may be used. Note that, the image forming apparatus 1 of the present embodiment adopts a two beam technique in which a plurality of laser beams are used to prevent laser beams from being emitted in rapid succession. In this manner, the image forming apparatus 1 carries out a high speed printing process.

The developing device 3 visualizes the electrostatic latent image, formed on the surface of the photoreceptor drum 10, with toner (black toner herein), so as to form a toner image.

The transfer unit 11 transfers the toner image, which has been visualized on the photoreceptor drum 10 by the developing device 3, onto a transported sheet.

The fixing unit 6 causes the sheet, to which the unfixed toner image has been transferred by the transfer unit 11, to pass through a space between the rotatable fixing roller (fixing member) 12 and the pressure roller (pressure member) 13 for pressing the fixing roller 12 (hereinafter, the space is referred to as "fixing nip section") and fuses the toner image on the sheet so as to fix the toner image on the sheet. The fixing unit 6 will be detailed later.

The cleaning unit 5 removes and collects toner remaining on the surface of the photoreceptor drum 10 after carrying out the development and the image transfer.

The sheet feed tray 8 is a tray on which sheets for forming images thereon are stored. In the present embodiment, a plurality of sheet feed trays 8 are provided on a lower portion of the image forming apparatus 1 and each tray stores 500 to 1500 sheets of a determinate form size so as to carry out a high speed printing process with respect to a large number of sheets. Further, in addition to the feed tray 8, a large capacity sheet feed cassette (LCC) 81 which stores a large amount of sheets (plural types of sheets) and a manual sheet feed tray which is used mainly to print irregular sized paper sheets are provided on a side portion of the image forming apparatus 1.

The output paper tray 9 holds sheets on which images have been formed. The output paper tray 9 is disposed on a side portion of the image forming apparatus 1 so as to be positioned opposite to the manual sheet feed tray 82. Further, the image forming apparatus 1 of the present embodiment is arranged so as to allow installation of not the output paper tray 9 but a post-processing device for performing a stapling process, a punching process, and the like, with respect to sheets having images thereon, and a plurality of output paper trays, as options.

The control section 50 controls operations of the respective sections and processes an image corresponding to image data. The control section 50 is a microcomputer including at least CPU and RAM and functions by reading a program stored in a storage medium (not shown). As will be detailed later, a below-mentioned fixing control section (control section: control means) 30 is constituted of the control section 50.

Figure 3:
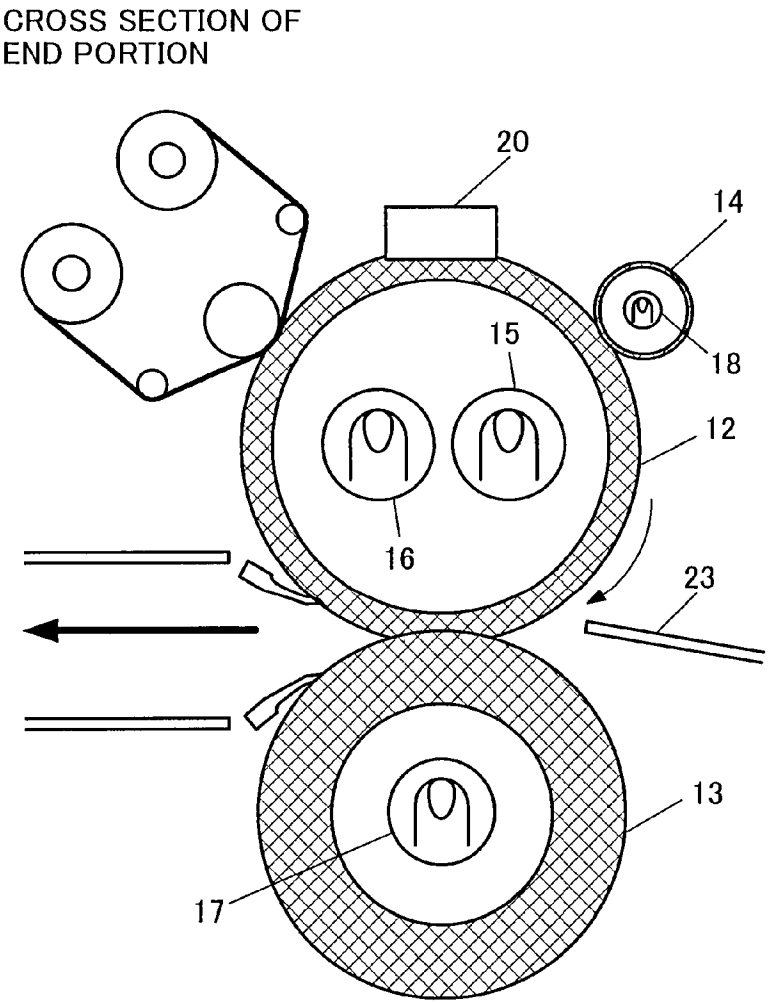
FIG. 3(*a*) is a cross sectional view of a central portion of the fixing unit.
Figure 3:
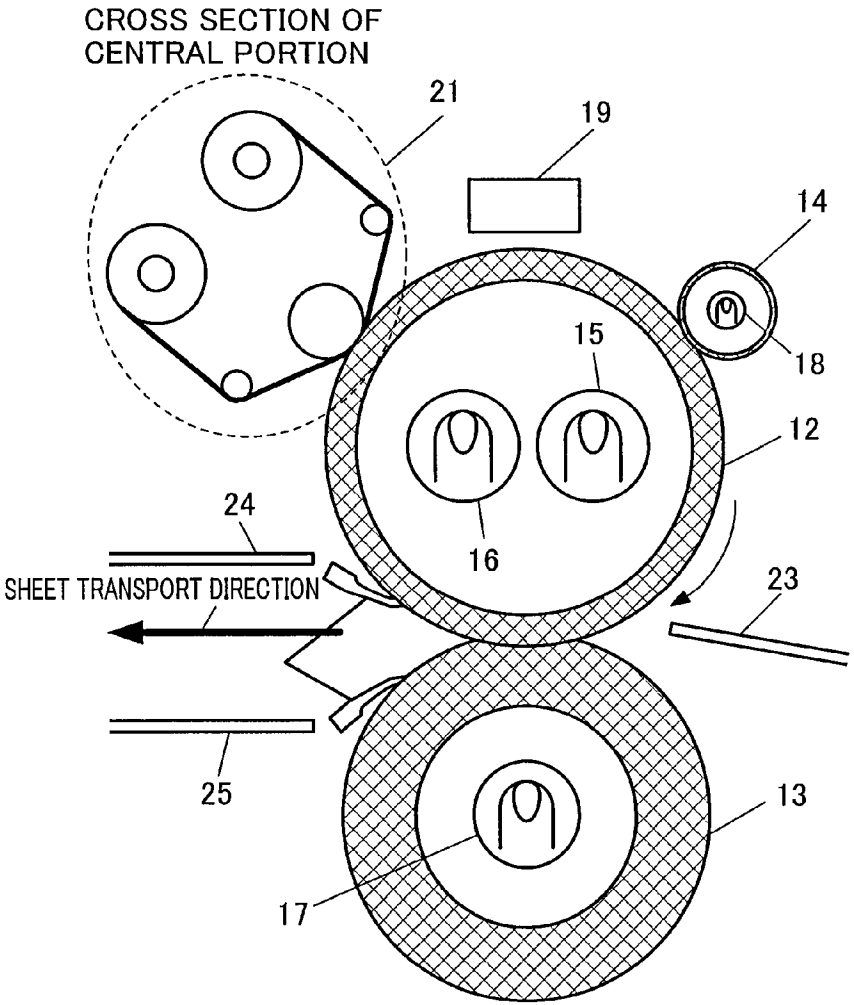

Next, the fixing unit 6 is described as follows. Each of FIGS. 3(*a*) and 3(*b*) is a cross sectional view schematically illustrating the fixing unit 6. FIG. 3(*a*) is a cross sectional view of central portions of the fixing roller 12 and the pressure roller 13. FIG. 3(*b*) is a cross sectional view of end portions of the fixing roller 12 and the pressure roller 13. Further, FIG. 4 illustrates how the fixing roller 12, the pressure roller 13, and a below-described external heating roller 14 are disposed.

The fixing roller 12 is heated to a predetermined temperature so as to heat a sheet which has a toner image thereon (unfixed toner image) and passes through the fixing nip section. The fixing roller 12 is arranged by winding silicone rubber (2 to 3 mm) serving as an elastic layer around a cylinder made of metal such as iron, stainless steel, aluminum, copper, and the like, alloy thereof, or the like, for example. The layer made of silicone rubber also allows thermal storage. Further, a release layer (not shown) made of fluorocarbon resin such as PFA (copolymer of tetrafluoroethylene and perfluoroalkylvinylether), PTFE (polytetrafluoroethylene), and the like, may be provided on the elastic layer.

The fixing roller 12 is arranged so that a heat source for causing a surface of the fixing roller 12 to have a temperature necessary to fix the toner image is provided in the cylinder. The surface of the fixing roller 12 is heated by the heat source to a preset fixing temperature (180° C. in this arrangement, generally 160 to 200° C.). In the arrangement illustrated in FIG. 3, a main heater 15 and a sub-heater 16 are provided as two heat sources so that the central portion and the end side of the surface of the fixing roller 12 are respectively heated.

Figure 4:
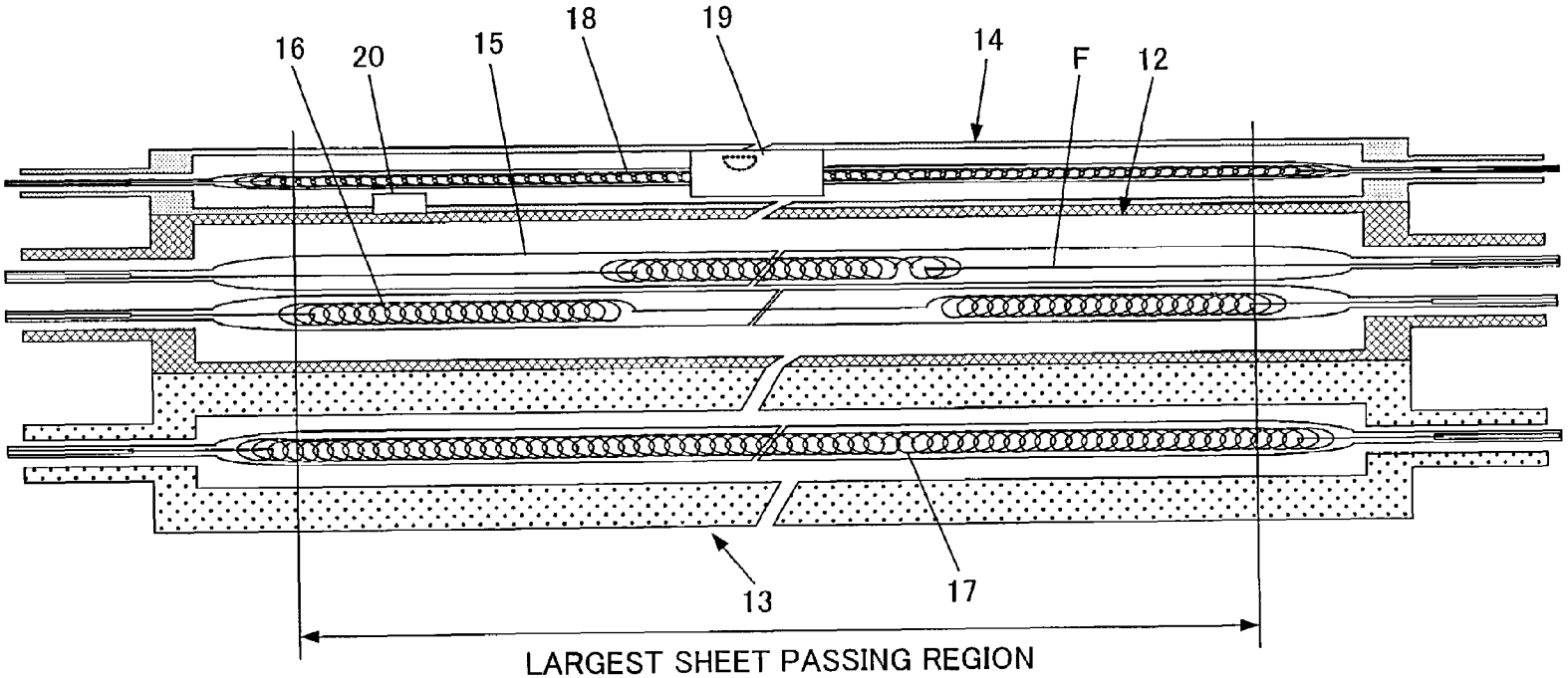
FIG. 4 is a diagram illustrating an arrangement of a fixing roller, a pressure roller, and an external heating roller, all of which are provided on the fixing unit.

As illustrated in FIG. 4, the main heater 15 is arranged so that a filament F is winded around a roller central portion, and this portion serves as a heating region so as to heat the central portion of the fixing roller 12. While, the sub-heater 16 is arranged so that filaments F are respectively winded around both ends positioned outside the heating region of the main heater 15, and these portions serve as heating regions so as to heat both ends of the fixing roller 12.

Further, a temperature sensor 19 made of thermistor for detecting surface temperature of the fixing roller 12 is provided above the central portion of the fixing roller 12, and a temperature sensor 20 made of thermistor for detecting temperature of the surface of the fixing roller 12 is provided on the end portion of the fixing roller 12. The temperature sensor 19 which can partially heat the surface of the fixing roller 12 constitutes temperature detecting means for detecting a surface temperature of a portion corresponding to the heating region of the main heater 15 serving as the heat source, and the temperature sensor 20 which can partially heat the surface of the fixing roller 12 constitutes temperature detecting means for detecting a surface temperature of a portion corresponding to the heating region of the sub-heater 16 serving as the heat source.

Above all, the central portion temperature sensor 19 for detecting temperature of the central portion is disposed so as not to be in contact with the surface of the fixing roller 12, and the end portion temperature sensor 20 for detecting temperature of the end portion is disposed so as to be in contact with the fixing roller 12. A reason for which the central portion temperature sensor 19 is not in contact with the fixing roller 12 is as follows. The sheet passes through the central portion more frequently than the end portion, so that the sheet adhering to the surface of the fixing roller 12 is highly likely to damage the central portion. The below-described temperature control section 32 corrects shift in temperature detected by the central portion temperature sensor 19 so as to correspond to a distance from the surface of the fixing roller 12.

While, the pressure roller 13 has a pressing mechanism (not shown) in its end, and the pressing mechanism causes the pressure roller 13 to be pressed against the fixing roller 12 at a predetermined pressure. The pressure roller 13 is constituted by winding silicone rubber (5 to 10 mm) serving as an elastic layer around a cylinder made of metal such as iron, stainless steel, aluminum, copper, and the like, alloy thereof, or the like. As in the fixing roller 12, the layer made of silicone rubber also allows thermal storage.

Further, a pressure roller heater 17 serving as the heat source and a heat source is provided in the pressure roller 13, so as to allow heat amount to be less conducted from the fixing roller 12 to the pressure roller 13.

A paper separation claw 22 for peeling a sheet adhering to en external periphery of the fixing roller 12 is provided on the external periphery of the fixing roller 12, and another paper separation claw 22 for peeling a sheet adhering to en external periphery of the pressure roller 13 is provided on the external periphery of the pressure roller 13. Further, a cleaning unit 21 for removing toner adhering to the surface of the fixing roller 12 is provided on the external periphery of the fixing roller 12.

The sheet guided along a paper guide 23 by the transfer unit 11 (see FIG. 2) passes through the fixing nip section, and then is separated from the fixing roller 12 or the pressure roller 13 by the paper separation claws 22. Thereafter, the sheet is transported along the paper guides 24 and 25. Further, the surface of the fixing roller 12 from which the sheet has been separated is cleaned by the cleaning unit 21.

Further, in the image forming apparatus 1 of the present embodiment, there is provided the external heating roller 14 for heating the fixing roller 12 from its surface side in order to perform a high speed printing process. The external heating roller 14 is arranged so that an external heating roller heater 18 serving as a heat source is provided in an extremely thin cylinder made of aluminum, iron, or the like. The thickness of the cylinder of the external heating roller 14 varies depending on the material, but ranges from 0.2 to 0.5 mm. This allows the temperature of the external heating roller 14 to be quickly raised by the heat of the external heating roller heater 18, thereby heating the surface of the fixing roller 12.

Further, the fixing unit 6 is arranged so that: only the fixing roller 12 out of the fixing roller 12, the pressure roller 13, and the external heating roller 14, is connected to a driving source and is rotated by the driving source, and a surface of the pressure roller 13 and a surface of the external heating roller 14 come into contact with the surface of the fixing roller 12 so as to be rotated by the fixing roller 12.

FIG. 1 is a block diagram illustrating a control system of the fixing unit 6. In FIG. 1, a reference numeral 30 represents a fixing control section (control section: control means), and the fixing control section 30 controls a condition under which the fixing roller 12 is driven and a condition under which power is supplied to the main heater 15, the sub-heater 16, the pressure roller heater 17, and the external heating roller heater 18.

The fixing control section 30 includes a main control section 37, a motor control section 31, and a temperature control section 32. The motor control section 31 controls a motor 35 which is the driving source for rotating the fixing roller 12 via a motor driver 34. In response to an instruction from the main control section 37, the motor control section 31 controls the motor 35.

The temperature control section 32 adjusts power supplied to the main heater 15, the sub-heater 16, the pressure roller heater 17, and the external heating roller heater 18, by using heaters corresponding thereto. Specifically, the temperature control section 32 controls turning ON/OFF of the main heater 15, the sub-heater 16, the pressure roller heater 17, and the external heating roller heater 18.

In response to an instruction from the main control section 37, the temperature control section 32 carries out the warm up step (carried out as the temperature raising step) so that the surface temperature of the fixing roller 12 is equal to the preset fixing temperature, in accordance with temperatures detected by the central portion temperature sensor 19 and the end portion temperature sensor 20.

Further, in response to an instruction from the main control section 37, the temperature control section 32 turns ON/OFF the heaters 15 to 18 so that the surface temperature of the fixing roller 12 is equal to the preset temperature, in accordance with temperatures detected by the central portion temperature sensor 19 and the end portion temperature sensor 20.

While carrying out the printing process and in an ordinary standby mode, the temperature control section 32 carries out adjustment so that the surface temperature of the fixing roller 12 is equal to the preset fixing temperature. Meanwhile, in case where each sleep mode is selected, adjustment is carried out so that the surface temperature of the fixing roller 12 becomes equal to the preset temperature which is set in accordance with each sleep mode.

In the image forming apparatus 1, three sleep modes are set. In a first sleep mode, the image forming apparatus 1 stands by at a temperature which has been set so that the printing process is carried out right after the user requests the printing process while reducing the power consumption. The temperature set in this mode is slightly lower than the preset fixing temperature. This mode is referred to also as an "energy saving mode".

In a second sleep mode, the power consumption is further reduced. After the user requests the printing process, the temperature is raised to the preset fixing temperature by carrying out the warm up step. Thus, a temperature at the time of standby is set so as to be much lower than the preset fixing temperature.

In a third mode, the power consumption is reduced to the lowest level. After the user requests the printing process, the temperature is raised to the preset fixing temperature after carrying out the warm up step for a period equal to the warm up period on start up. During the standby period, the fixing roller 12 is not heated. This mode is referred to also as a "shut-off mode".

The main control section 37 outputs instruction signals to the motor control section 31 and the temperature control section 32. The main control section 37 receives a print request signal, a mode signal indicative of a type of the sleep mode, a power ON/OFF signal indicative of whether the image forming apparatus 1 is turned ON or OFF, a detection signal of a sheet delivery detection sensor 33, and a similar signal. In accordance with each of the signals, the main control section 37 outputs an instruction signal. The sheet delivery detection sensor 33 is a sensor for detecting delivery of the sheet to the outside of the fixing unit 6.

Note that, in FIG. 1, for convenience in description, the main heater 15 and the sub-heater 16 which are heat sources for heating the fixing roller and are respectively controlled are referred to as a "fixing roller heater 39", and the fixing roller heater 39 is adjusted by a fixing heater driver 38. Further, illustration of the pressure roller heater 17 is omitted.

Further, the main control section 37 instructs the motor control section 31 and the temperature control section 32 to carry out a first fixing member maintenance process in which the fixing roller 12 is kept rotating during a predetermined period after turning OFF the external heating roller heater 18 disposed in the external heating roller 14 when shifting from the temperature raising step carried out so that the surface temperature of the fixing roller 12 becomes equal to the preset fixing temperature into the standby mode.

As described above, when the rotation of the fixing roller 12 is stopped at the same time as turning OFF the external heating roller heater 18, there occurs overshoot in which the surface temperature of the external heating roller 14 suddenly rises, which may result in deterioration or breakage of the fixing roller 12. However, in the image forming apparatus 1 of the present invention, the first fixing member maintenance process is carried out, so that the fixing roller 12 is kept rotating for a predetermined period after turning OFF the external heating roller heater 18.

As a result, no overshoot occurs, and the surface temperature of the external heating roller 14 does not exceed the durable temperature of the fixing roller 12 at the time when the rotation of the fixing roller 12 stops, so that it is possible to prevent deterioration or breakage of the fixing roller 12.

Figure 5:
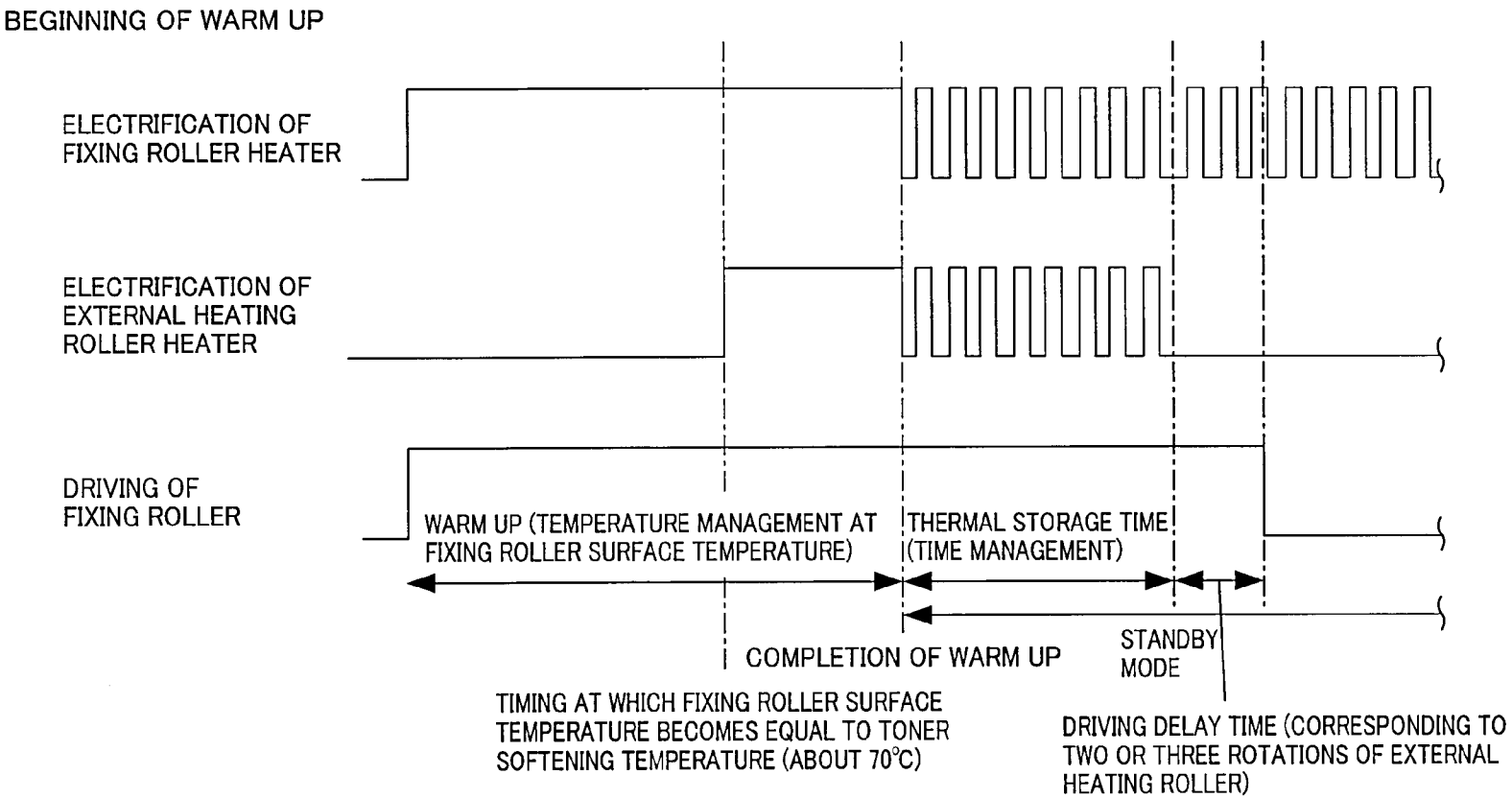
FIG. 5 is a timing chart illustrating a condition under which electrification of a fixing roller heater and electrification of an external heating roller heater are controlled and driving of the fixing roller is controlled during a standby period which follows the warm up step after turning ON the apparatus and shifting into a standby mode.

Specifically, when turning OFF the external heating roller heater 18 after shifting from the warm up step on start up to the standby mode as illustrated in FIG. 5, and when turning OFF the external heating roller heater 18 after shifting from the temperature raising step at the time of completion of the printing process to the standby mode, the first fixing member maintenance process is carried out.

FIG. 5 is a timing chart indicative of (i) control of electrifications of the fixing roller heater 39 and the external heating roller heater 18 and (ii) control of driving of the fixing roller 12 during the standby period after shifting from the beginning of the warm up step on start up to the standby mode. FIG. 7 is a timing chart indicative of (i) control of electrifications of the fixing roller heater 39 and the external heating roller heater 18 and (ii) control of driving of the fixing roller 12 during a period shifting from completion of the printing process to the standby mode. Further, FIG. 6 illustrates transitions of surface temperatures of the fixing roller 12, the pressure roller 13, and the external heating roller 14 during the standby period after shifting from the beginning of the warm up step on start up to the standby mode.

Figure 6:
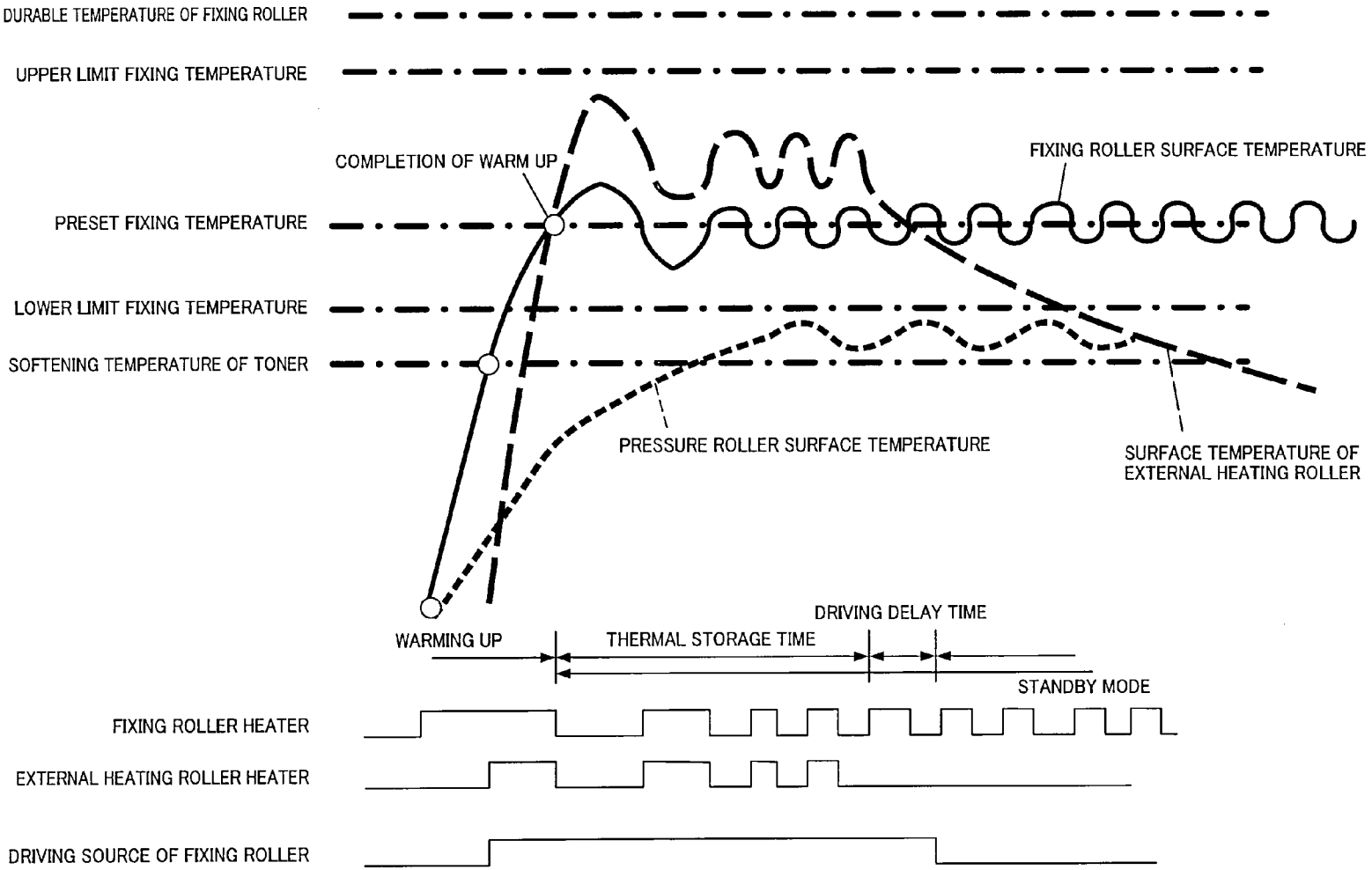
FIG. 6 is a diagram illustrating a condition under which surface temperatures of a fixing roller, a pressure roller, and an external heating roller transit together with a condition under which electrification of the fixing roller heater and electrification of the external heating roller heater are controlled and driving of the fixing roller is controlled during a standby period which follows the warm up step after turning ON the apparatus and shifting into a standby mode.
Figure 7:
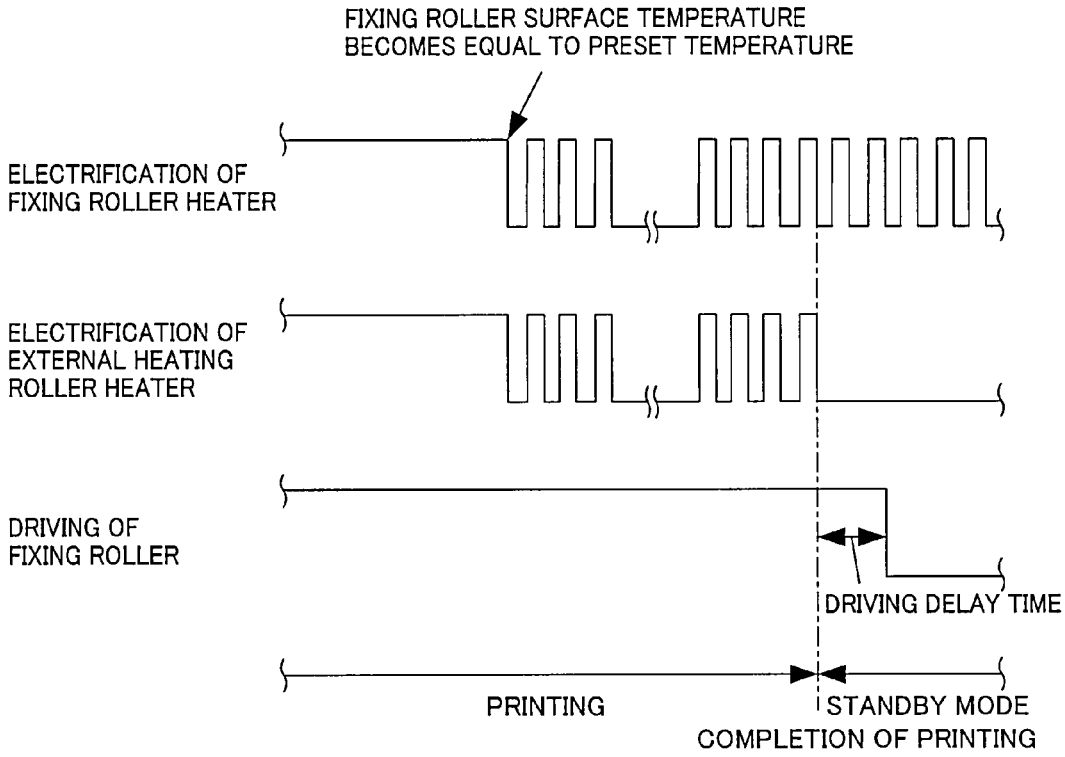
FIG. 7 is a timing chart illustrating a condition under which electrification of the fixing roller heater and electrification of the external heating roller heater are controlled and driving of the fixing roller is controlled during a period after finishing a printing process and shifting into a standby mode.

In the warm up step on start up, as illustrated in FIG. 5 and FIG. 6, when the surface temperature of the fixing roller 12 becomes equal to the preset fixing temperature, the image forming apparatus shifts to the standby mode, and the fixing roller heater 39 and the external heating roller heater 18 are turned OFF, and also the fixing roller 12 stops rotating. In the image forming apparatus 1, a driving delay time is set. After turning OFF the external heating roller heater 18, the fixing roller 12 is additionally rotated for a time corresponding to the driving delay time.

Thus, as illustrated in FIG. 6, the surface temperature of the external heating roller 14 does not exceed the durable temperature of the fixing roller 12 at the time when the fixing roller 12 stops rotating.

This condition is kept in shifting from completion of the printing process to the standby mode. As illustrated in FIG. 7, after the printing process is finished and the surface temperature of the fixing roller 12 becomes equal to the preset fixing temperature, the image forming apparatus shifts to the temperature control carried out in the standby period in which the preset fixing temperature is kept, and then the driving of the fixing roller 12 is stopped. In this case, after turning OFF the external heating roller heater 18, the fixing roller 12 is additionally rotated for a time corresponding to the driving delay time.

The driving delay time in which the rotation of the fixing roller 12 is kept is equal to at least a time taken for a surface temperature of a portion of the external heating roller 14 which portion is in contact with the fixing roller 12 to drop to the durable temperature or lower of the surface of the fixing roller 12. It is more preferable that the driving delay time is equal to a time taken for the surface temperature to drop to the preset fixing temperature or lower.

In the image forming apparatus 1, after turning OFF the external heating roller heater 18, the external heating roller 14 is additionally rotated twice or three times. The driving delay time, the number of times additionally rotated, or a similar condition varies depending on how the external heating roller 14 is arranged, so that each of the conditions is suitably set on the basis of a test.

Further, the image forming apparatus 1 is arranged so that: in addition to the first fixing member maintenance process, the main control section 37 instructs the motor control section 31 and the temperature control section 32 to carry out a second fixing member maintenance process for turning ON the external heating roller heater 18 at a timing later than a timing at which the fixing roller heater 39 is turned ON, in the temperature raising step on start up or in the temperature raising step carried out in being restored from each sleep mode.

As described above, the external heating roller 14 tends to be quickly heated, and its surface temperature sharply rises. Thus, when the heating is started in the same manner as in the fixing roller 12, there is a possibility that the surface temperature may exceed the upper limit fixing temperature even if the external heating roller heater 18 is turned OFF at the time when the surface temperature of the fixing roller 12 becomes equal to the preset fixing temperature. However, in the image forming apparatus 1, the second fixing member maintenance process is carried out, and the external heating roller heater 18 is turned ON at a timing later than a timing at which the fixing roller heater 39 is turned ON.

As a result, even if the external heating roller heater 18 is turned OFF at the time when the surface temperature of the fixing roller 12 becomes equal to the preset fixing temperature, the surface temperature hardly rises excessively and hardly exceeds the upper limit fixing temperature.

Figure 8:
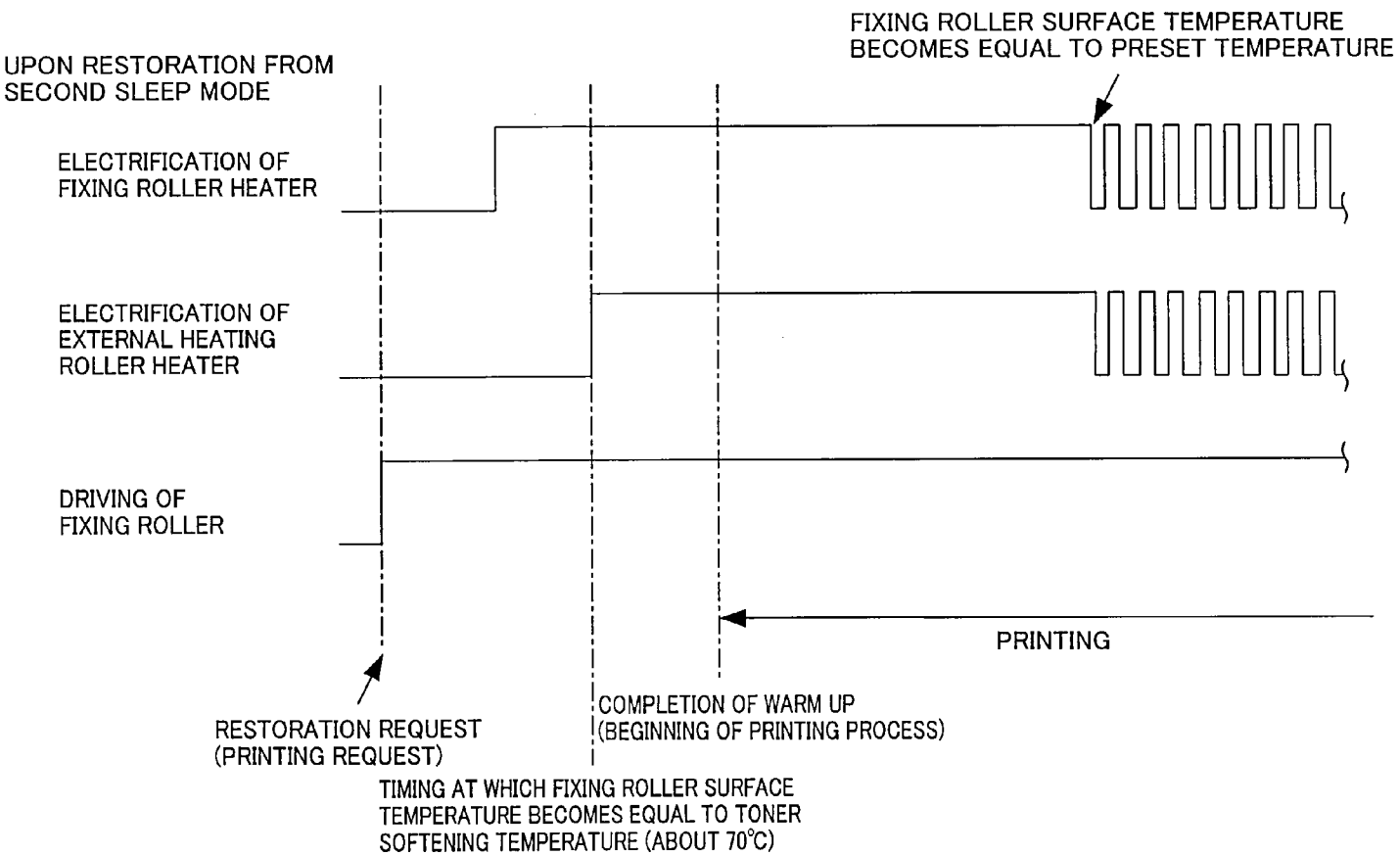
FIG. 8 is a timing chart illustrating electrification of the fixing roller heater and electrification of the external heating roller heater are controlled and driving of the fixing roller is controlled during a period shifting from a second sleep mode into a printing process.

Specifically, as illustrated in FIG. 5 and FIG. 8, in the warm up step, right after turning ON the image forming apparatus, in which the surface temperature of the fixing roller 12 rises from a temperature lower than a softening temperature of the toner, and in the warm up step after being restored from the second sleep mode, the fixing roller heater 39 is first turned ON after turning ON the image forming apparatus or receiving any printing request, and the external heating roller heater 18 is turned ON when the surface temperature of the fixing roller 12 becomes equal to the softening temperature of the toner.

Figure 9:
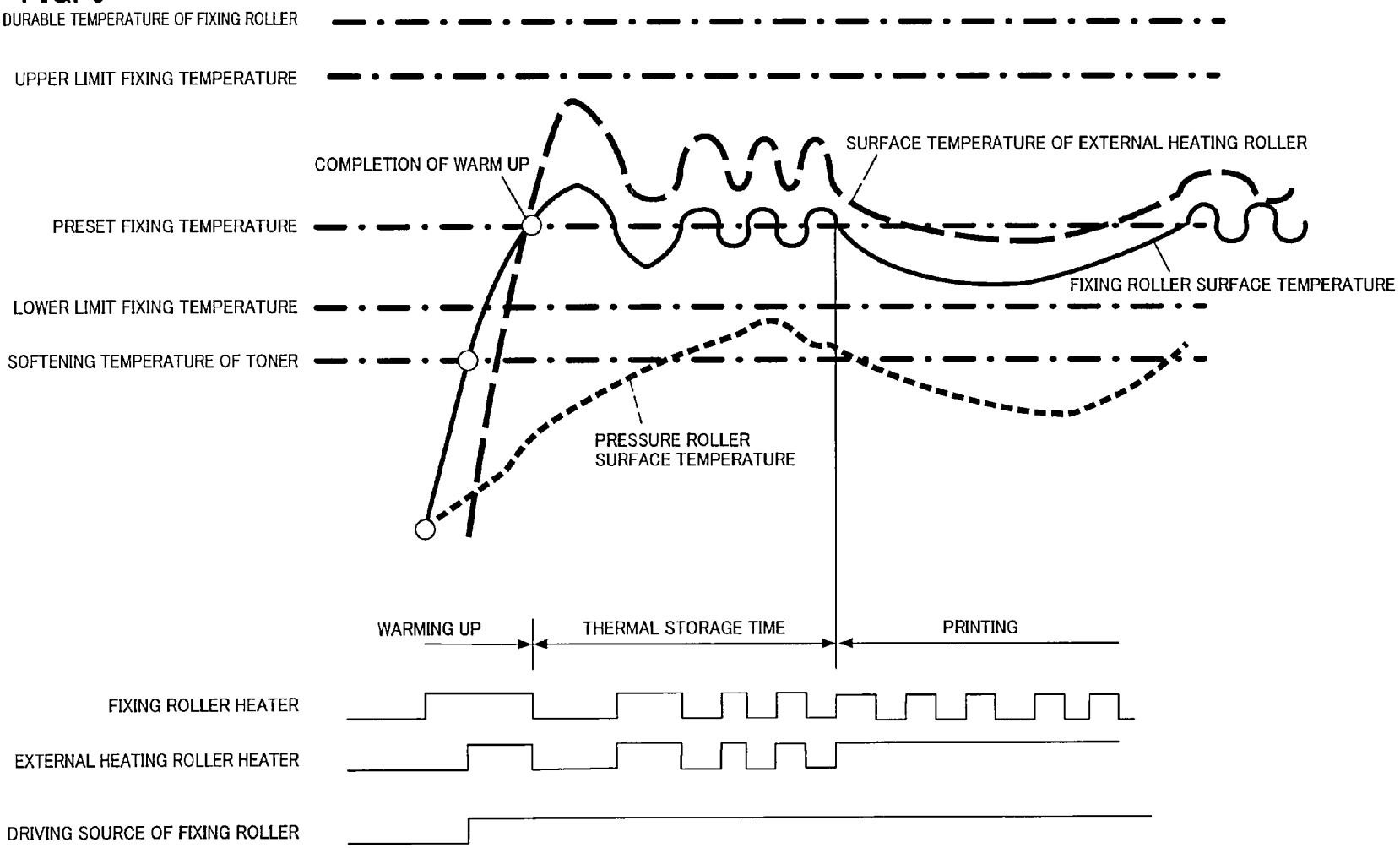
FIG. 9 is a diagram illustrating a condition under which surface temperatures of a fixing roller, a pressure roller, and an external heating roller transit together with a condition under which electrification of the fixing roller heater and electrification of the external heating roller heater are controlled and driving of the fixing roller is controlled during a period shifting from the second sleep mode into a printing process.

FIG. 8 is a timing chart indicative of a condition under which electrification of the fixing roller heater 39 and electrification of the external heating roller heater 18 are controlled and driving of the fixing roller 12 is controlled in a period in which the image forming apparatus is restored from the standby state in the second sleep mode and shifts to the printing process. FIG. 9 illustrates transitions of surface temperatures of the fixing roller 12, the pressure roller 13, and the external heating roller 14 during this period.

A timing at which the external heating roller heater 18 is turned ON is delayed from a timing at which the fixing roller heater 39 is turned ON, so that the surface temperature of the external heating roller 14 becomes not more than the preset fixing temperature in the warm up step on start up as illustrated in FIG. 6. As a result, it is possible to more effectively prevent deterioration or breakage of the fixing roller 12 which is caused by excessive heat.

Note that, in this arrangement, the fixing roller 12 begins rotating after the surface temperature of the fixing roller 12 becomes equal to the softening point of the toner. This arrangement is made in order to prevent the toner adhering to the surface of the fixing roller 12 from damaging the surface of the fixing roller 12.

Likewise, a timing at which the external heating roller heater 18 is turned ON is delayed from a timing at which the fixing roller 39 is turned ON, so that the surface temperature of the external heating roller 14 is lower than the upper limit fixing temperature in the warm up step at the time of restoration from the second sleep mode as illustrated in FIG. 9. As a result, it is possible to more effectively prevent deterioration or breakage of the fixing roller 12 which is caused by excessive heat.

Figure 10:
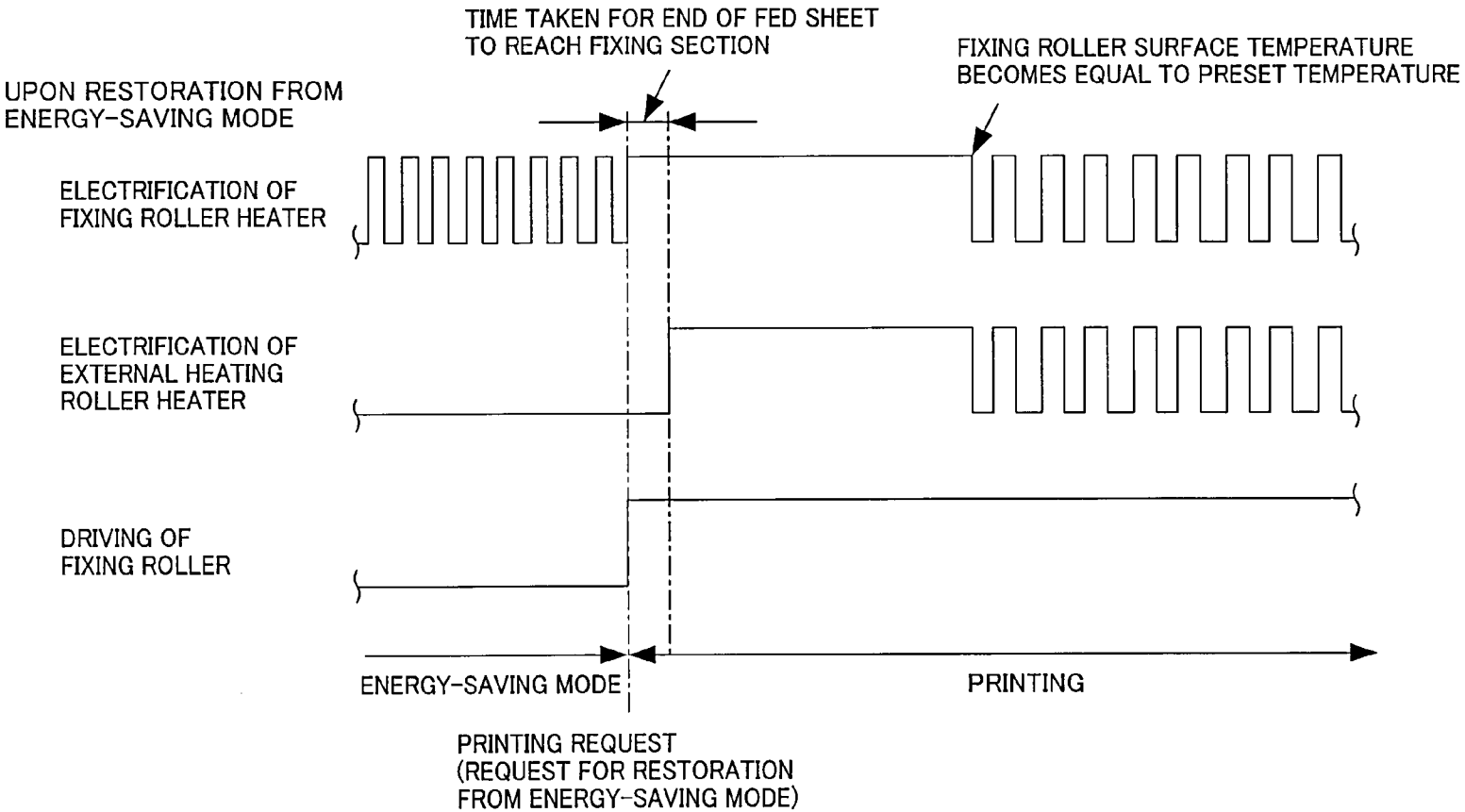
FIG. 10 is a timing chart illustrating electrification of the fixing roller heater and electrification of the external heating roller heater are controlled and driving of the fixing roller is controlled during a period shifting from a first sleep mode into a printing process.
Figure 11:
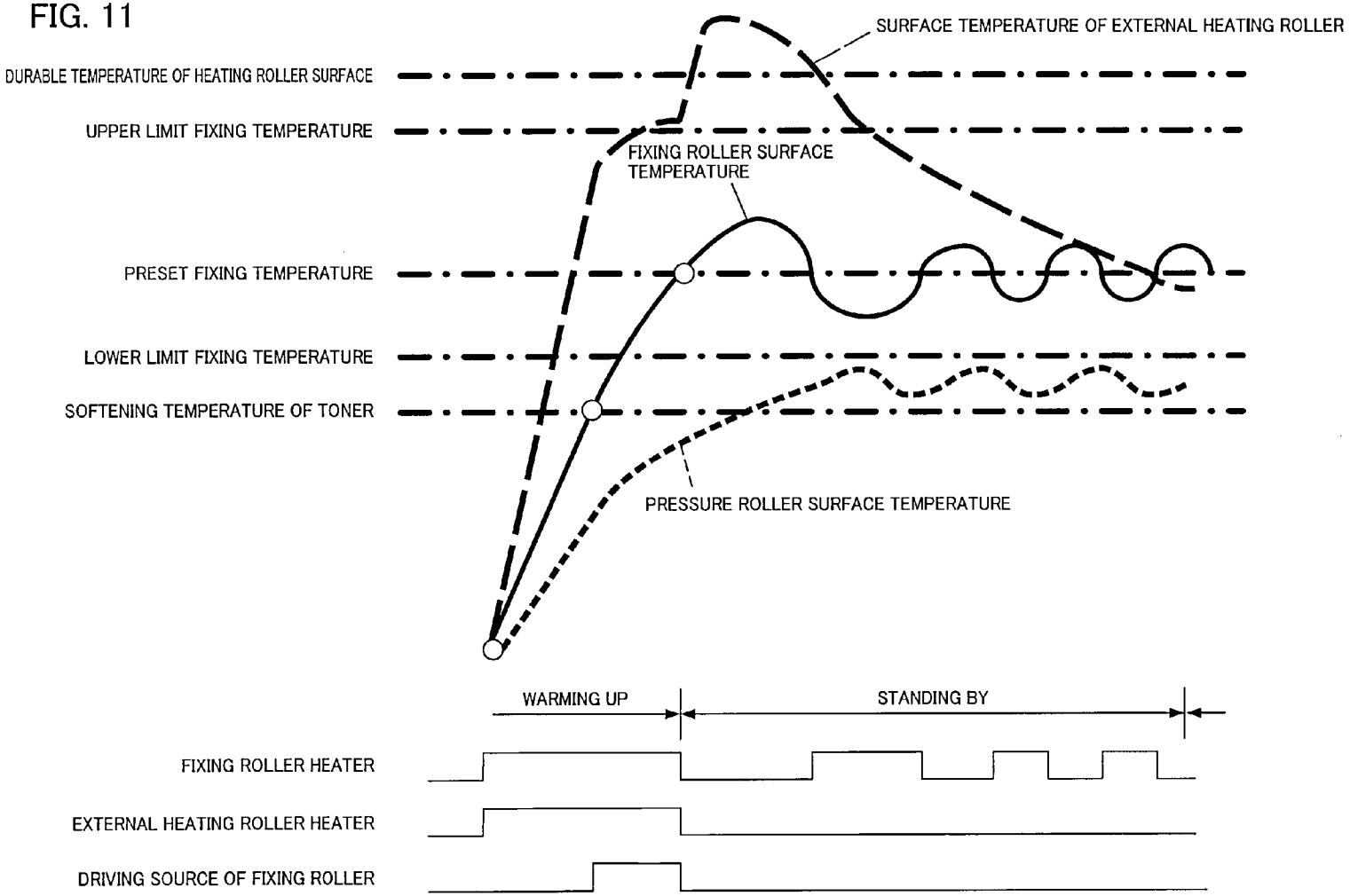
FIG. 11 is a diagram illustrating a condition under which surface temperatures of a fixing roller, a pressure roller, and an external heating roller transit together with a condition under which electrification of the fixing roller heater and electrification of the external heating roller heater are controlled and driving of the fixing roller is controlled during standby period which follows the warm up step after turning ON the apparatus and shifting into a standby mode.

Further, as illustrated in FIG. 10, in the temperature raising step at the time when the image forming apparatus is restored from the first sleep mode (energy-saving mode) in which step the surface temperature of the fixing roller 12 rises from a temperature higher than the softening point of the toner and lower than the preset fixing temperature, the fixing roller heater 39 is turned ON at a timing when the printing process is requested, and the external heating roller heater 18 is turned ON at a timing when an end of the first fed sheet reaches the fixing nip section.

FIG. 10 is a timing chart indicative of a condition under which electrification of the fixing roller heater 39 and electrification of the external heating roller heater 18 are controlled and driving of the fixing roller 12 is controlled during a period in which the image forming apparatus is restored from the standby state in the first standby mode and shifts to the printing process.

Further, in the image forming apparatus 1, the main control section 37 instructs the motor control section 31 and the temperature control section 32 to carry out the following process: in the warm up step on start up, if the image forming apparatus shifts to the standby mode through the warm up step, the external heating roller heater 18 is not immediately turned OFF, but a thermal storage process in which ON/OFF of the external heating roller heater 18 and ON/OFF of the fixing roller heater 39 are synchronously controlled is carried out for a predetermined time as illustrated in FIG. 5 and FIG. 6.

The second fixing member maintenance process is carried out, so that the surface temperature of the external heating roller 14 hardly rises excessively and hardly exceeds the fixation upper limit temperature after finishing the warm up step. As a result, the external heating roller heater 18 allows the thermal storage process. Thus, the time taken to carry out the thermal storage of the fixing roller 12 can be made shorter than that in the arrangement in which the thermal storage is carried out only by the fixing roller heater 39.

As described above, a fixing apparatus of the present invention includes: a fixing member which is rotatable; a pressure member for pressing the fixing member; and an external heating member for coming into contact with a surface of the fixing member so as to heat the surface from outside, a recording material being allowed to pass through a space between the fixing member and the pressure member so as to fix a toner image formed on the recording material, said fixing apparatus comprising a control section for controlling a state in which the fixing member is driven and for controlling a state in which power is supplied to heat sources respectively provided in the fixing member and the external heating member, wherein the control section carries out a first fixing member maintenance process, in which the fixing member is kept rotating also after stopping supplying power to the heat source of the external heating member, when shifting from a temperature raising step for raising a surface temperature of the fixing member so that the surface temperature is equal to a preset fixing temperature to a standby mode so as to stop supplying power to the heat source of the external heating member.

An image forming apparatus of the present invention includes a fixing apparatus which includes: a fixing member which is rotatable; a pressure member for pressing the fixing member; and an external heating member for coming into contact with a surface of the fixing member so as to heat the surface from outside, a recording material being allowed to pass through a space between the fixing member and the pressure member so as to fix a toner image formed on the recording material, said fixing apparatus including a control section for controlling a state in which the fixing member is driven and for controlling a state in which power is supplied to heat sources respectively provided in the fixing member and the external heating member, wherein the control section carries out a first fixing member maintenance process, in which the fixing member is kept rotating also after stopping supplying power to the heat source of the external heating member, when shifting from a temperature raising step for raising a surface temperature of the fixing member so that the surface temperature is equal to a preset fixing temperature to a standby mode so as to stop supplying power to the heat source of the external heating member.

As described above, when the rotation of the fixing member is stopped at the same time as in stopping supplying power to the heat source of the external heating member, there occurs overshoot which is sudden rise of the surface temperature of the external heating member, so that the fixing member may be deteriorated or broken.

According to the foregoing arrangement, the first fixing member maintenance process is carried out, so that the fixing member keeps rotating for a predetermined period also after stopping supplying power to the heat source of the external heating member. Thus, no overshoot occurs, and the surface temperature of the external heating member does not exceed the durable temperature of the fixing member at the time when the fixing member stops rotating. As a result, it is possible to prevent deterioration or breakage of the fixing member.

The first fixing member maintenance process can be carried out, for example, in finishing the temperature raising step on start up or in finishing the temperature raising step after finishing the printing process.

An example of the predetermined period in which the first fixing member maintenance process is carried out so as to keep the fixing member rotating is a period in which the surface temperature of the external heating member drops in a portion which is in contact with the fixing member so as to be equal to or lower than the durable temperature of the surface of the fixing member.

Further, a more preferable example of the predetermined period in which the first fixing member maintenance process is carried out so as to keep the fixing member rotating is a period in which the surface temperature of the external heating member drops in a portion which is in contact with the fixing member so as to be equal to or lower than the preset fixing temperature. This more effectively prevents deterioration or breakage of the fixing member.

The fixing apparatus of the present invention is arranged so that the control section carries out a second fixing member maintenance process, in which time for beginning to supply power to the heat source of the external heating member is delayed from time for beginning to supply power to the heat source of the fixing member, when carrying out a temperature raising step on start up or a temperature raising step upon restoration from a sleep mode.

As described above, the external heating member has the quick heating property and its surface temperature quickly rises. Thus, upon beginning to heat the external heating member as in the fixing member, the surface temperature of the external heating member may exceed the preset fixing temperature even if supply of power to the heat source of the external heating member is stopped at the time when the surface temperature of the fixing member becomes equal to the preset fixing temperature.

According to the foregoing arrangement, the control section carries out the second fixing member maintenance process, so that power comes to be supplied to the heat source of the external heating member at a later timing than a timing at which power comes to be supplied to the heat source of the fixing member. Thus, even if supply of power to the heat source of the external heating member is stopped at the time when the surface temperature of the fixing member becomes equal to the preset fixing temperature, the surface temperature hardly rises excessively beyond the upper limit fixing temperature.

In delaying a timing at which supply of power to the heat source of the external heating member is begun, the control section begins to supply power to the heat source of the external heating member at a timing, at which a leading end of a first fed recording material reaches the space between the fixing member and the pressure member, when carrying out a temperature raising step upon restoration from a first sleep mode in which step the surface temperature of the fixing member rises from a temperature higher than a softening temperature of toner and lower than the preset fixing temperature.

Further, it is arranged so that the control section begins to supply power to the heat source of the external heating member when the surface temperature of the fixing member attains a softening temperature of toner, in carrying out a temperature raising step on start up or a temperature raising step upon restoration from a second sleep mode in which step the surface temperature of the fixing member rises from a temperature lower than the softening temperature of the toner.

In addition, it is so arranged that in the temperature raising step on start up, the control section carries out a thermal storage process, in which supply of power to the heat source of the external heating member is controlled in synchronization with supply of power to the heat source of the fixing member, for a predetermined time upon shifting from the temperature raising step to a standby mode, and then the control section stops supplying power to the heat source of the external heating member.

The second fixing member maintenance process is carried out, so that the surface temperature of the external heating member hardly rises excessively beyond the upper limit fixing temperature upon finishing the temperature raising step. Thus, the heat source of the external heating member allows thermal storage process, so that the time taken to carry out thermal storage of the fixing member can be made shorter than that in case where the thermal storage is carried out only by the heat source of the fixing member.

The present invention is not limited to the description of the embodiments above, but may be altered by a skilled person within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus, comprising: a fixing member which is rotatable; a pressure member for pressing the fixing member; and an external heating member for coming into contact with a surface of the fixing member so as to heat the surface from outside, a recording material being allowed to pass through a space between the fixing member and the pressure member so as to fix a toner image formed on the recording material, said fixing apparatus comprising a control section for controlling a state in which the fixing member is driven and for controlling a state in which power is supplied to heat sources respectively provided in the fixing member and the external heating member, wherein the control section carries out a first fixing member maintenance process, in which the fixing member is kept rotating also after stopping supplying power to the heat source of the external heating member, when shifting from a temperature raising step for raising a surface temperature of the fixing member so that the surface temperature is equal to a preset fixing temperature to a standby mode so as to stop supplying power to the heat source of the external heating member, and based on a surface temperature of the external heating member, the control section keeps the fixing member rotating during a period in which a surface temperature of the external heating member drops in a contact portion with respect to the fixing member so as to be equal to or lower than a durable temperature of the surface of the fixing member; and the control section carries out a second fixing member maintenance process, in which time for beginning to supply power to the heat source of the external heating member is delayed from a time for beginning to supply power to the heat source of the fixing member, when carrying out a temperature raising step on start up or a temperature raising step upon restoration from a sleep mode;

wherein the control section begins to supply power to the heat source of the external heating member when the surface temperature of the fixing member attains a softening temperature of toner, in carrying out a temperature raising step on start up or a temperature raising step upon restoration from a second sleep mode in which the surface temperature of the fixing member rises from a temperature lower than the softening temperature of the toner, and after the toner softening temperature is reached both the heat source in the fixing member and the heat source in the external heating member are turned on until a fixing temperature is reached.

2. The fixing apparatus as set forth in claim 1, wherein the control section carries out the first fixing member maintenance process when finishing a temperature raising step on start up.

3. The fixing apparatus as set forth in claim 1, wherein the control section carries out the first fixing member maintenance process when finishing a temperature raising step upon finishing a printing process.

4. The fixing apparatus as set forth in claim 1, wherein the control section keeps the fixing member rotating during a period in which a surface temperature of the external heating member drops in a contact portion with respect to the fixing member so as to be equal to or lower than the preset fixing temperature.

5. The fixing apparatus as set forth in claim 4, wherein the control section begins to supply power to the heat source of the external heating member at a timing, at which a leading end of a first fed recording material reaches the space between the fixing member and the pressure member, when carrying out a temperature raising step upon restoration from a first sleep mode in which step the surface temperature of the fixing member rises from a temperature higher than a softening temperature of toner and lower than the preset fixing temperature.

6. The fixing apparatus as set forth in claim 1, wherein in the temperature raising step on start up, the control section carries out a thermal storage process, in which supply of power to the heat source of the external heating member is controlled in synchronization with supply of power to the heat source of the fixing member, for a predetermined time upon shifting from the temperature raising step to a standby mode, and then the control section stops supplying power to the heat source of the external heating member.

7. An image forming apparatus, comprising a fixing apparatus which includes: a fixing member which is rotatable; a pressure member for pressing the fixing member; and an external heating member for coming into contact with a surface of the fixing member so as to heat the surface from outside, a recording material being allowed to pass through a space between the fixing member and the pressure member so as to fix a toner image formed on the recording material, said fixing apparatus including a control section for controlling a state in which the fixing member is driven and for controlling a state in which power is supplied to heat sources respectively provided in the fixing member and the external heating member, wherein the control section carries out a first fixing member maintenance process, in which the fixing member is kept rotating also after stopping supplying power to the heat source of the external heating member, when shifting from a temperature raising step for raising a surface temperature of the fixing member so that the surface temperature is equal to a preset fixing temperature to a standby mode so as to stop supplying power to the heat source of the external heating member, and based on a surface temperature of the external heating member, the control section keeps the fixing member rotating during a period in which a surface temperature of the external heating member drops in a contact portion with respect to the fixing member so as to be equal to or lower than a durable temperature of the surface of the fixing member; and the control section carries out a second fixing member maintenance process, in which time for beginning to supply power to the heat source of the external heating member is delayed from a time for beginning to supply power to the heat source of the fixing member, when carrying out a temperature raising step on start up or a temperature raising step upon restoration from a sleep mode;

wherein the control section begins to supply power to the heat source of the external heating member when the surface temperature of the fixing member attains a softening temperature of toner, in carrying out a temperature raising step on start up or a temperature raising step upon restoration from a second sleep mode in which the surface temperature of the fixing member rises from a temperature lower than the softening temperature of the toner, and after the toner softening temperature is reached both the heat source in the fixing member and the heat source in the external heating member are turned on until a fixing temperature is reached.

* * * * *